US009404257B2

(12) United States Patent
Reno

(10) Patent No.: US 9,404,257 B2
(45) Date of Patent: Aug. 2, 2016

(54) TRUSS AND WALL STABILIZER

(71) Applicant: Howard Reno, Casa Grande, AZ (US)

(72) Inventor: Howard Reno, Casa Grande, AZ (US)

( * ) Notice: Subject to any disclaimer, the term of this patent is extended or adjusted under 35 U.S.C. 154(b) by 0 days.

(21) Appl. No.: 14/802,713

(22) Filed: Jul. 17, 2015

(65) Prior Publication Data

US 2016/0024791 A1 Jan. 28, 2016

Related U.S. Application Data

(60) Provisional application No. 62/025,808, filed on Jul. 17, 2014.

(51) Int. Cl.
*E04C 3/11* (2006.01)
*E04C 3/02* (2006.01)
*E04G 21/18* (2006.01)

(52) U.S. Cl.
CPC ..... *E04C 3/02* (2013.01); *E04G 21/1891* (2013.01); *E04C 2003/026* (2013.01)

(58) Field of Classification Search
CPC ..... E04C 3/02; E04G 21/1841; E04G 21/185; E04G 21/1883; E04G 21/1891; E04G 21/18; G01B 5/14
USPC ..... 52/745.21, 749.12, 690, 693, 696; 33/613
See application file for complete search history.

(56) References Cited

U.S. PATENT DOCUMENTS 2,837,910 A * 6/1958 Steed ..... E04G 21/1841 222/60
4,253,649 A * 3/1981 Hewson ..... B25B 1/22 269/45
4,322,064 A * 3/1982 Jarvis ..... E04G 21/1891 269/237
4,420,921 A * 12/1983 Hardin ..... E04F 21/00 269/43
5,161,345 A * 11/1992 Sobjack, Sr. ..... E04B 7/022 33/613
5,606,837 A * 3/1997 Holizlander ..... E04C 3/02 52/639
5,628,119 A * 5/1997 Bingham ..... E04G 21/1891 269/904
6,244,010 B1 * 6/2001 Sluiter ..... E04B 7/022 52/639
6,418,695 B1 * 7/2002 Daudet ..... E04B 7/022 52/639
6,993,882 B2 * 2/2006 Crawford ..... E04B 7/022 52/696
2006/0196068 A1 * 9/2006 Thompson ..... E04G 21/1891 33/613
2011/0154770 A1 * 6/2011 Friis ..... E04B 7/022 52/696
2011/0315476 A1 * 12/2011 Clarkson ..... E06C 7/48 182/107

* cited by examiner

*Primary Examiner* — Beth Stephan
(74) *Attorney, Agent, or Firm* — Daniel Boudwin; Global Intellectual Property Agency

(57) ABSTRACT

An apparatus for spacing and stabilizing truss members is provided. The apparatus includes an elongated channel member having a middle portion, a first arm portion, and a second arm portion. The first arm portion and second arm portion extend outwardly from the middle portion. A plurality of U-shaped clamp members may be disposed along the length of the elongated channel member. At least one U-shaped clamp member can be attached to a central truss member providing a centered layout for spacing a first truss member in relation to a second truss member. A hinge member may pivotally attach the middle portion of the elongated channel member to the second arm portion, allowing the second arm portion to swing onto an additional third truss member.

7 Claims, 4 Drawing Sheets

TRUSS AND WALL STABILIZER

CROSS REFERENCE TO RELATED APPLICATION

This application claims the benefit of U.S. Provisional Application No. 62/025,808 filed on Jul. 14, 2014. The above identified patent application is herein incorporated by reference in its entirety to provide continuity of disclosure.

FIELD OF THE INVENTION

The invention generally relates to an apparatus for stabilizing roof trusses. More particularly, the present invention relates to an apparatus for stabilizing and spacing roof trusses during construction and thereafter.

BACKGROUND OF THE INVENTION

Pre-manufactured wooden trusses greatly facilitate the construction of buildings and other structures. While these pre-manufactured trusses are strong and reliable in service, during construction they can topple if they are not properly supported. Moreover, to ensure that the trusses perform properly in service, it is important to make sure that they are properly spaced.

Presently, when trusses are used in construction they are placed in position and lateral braces are nailed across the top chords of the trusses to maintain the spacing and position of the trusses. As the trusses are tied together in the structure, for example by applying sheathing, the lateral braces are removed. This temporary attachment and subsequent removal of lateral braces is time consuming and thus expensive. Moreover, while this method of lateral bracing supports the trusses during construction, it provides no support after the braces are removed.

Various attempts have been made to help properly space and provide temporary support for trusses during construction. See for example, Baumker, Jr., U.S. Pat. No. 4,704,829; Allen, U.S. Pat. No. 3,959,945; Dean, U.S. Pat. No. D 318, 785; and Krueger, U.S. Pat. No. D 293,416. However, these have generally been elaborate devices that were too expensive and cumbersome to find practical application in the field. Moreover, these were typically temporary devices that had to be removed before construction was completed, with attendant labor costs, and thus they did not provide any post-construction support of the truss.

It would be desirable to provide a more simple and economical clamp apparatus which is operative once attached to a first truss member to capture and temporarily secure a second adjacent truss member, until the second truss member can be secured with appropriate space members and the like. It would also be desirable to provide an apparatus that assists in the erection of a truss, stabilizes and spaces the truss member with a desired space, and braces the truss to another previously erected truss.

SUMMARY OF THE INVENTION

In view of the foregoing disadvantages inherent in the known types of truss stabilizers now present in the prior art, the present invention provides an apparatus for stabilizing and spacing truss members wherein the same can be utilized for providing convenience for the user when installing truss members during construction.

The truss spacer and support of the present invention helps to provide accurate spacing between adjacent trusses, and helps support the trusses to prevent collapse of the structure while it is being constructed. The truss stabilizer provides additional support to the chords of the trusses, particularly against buckling forces.

It is one object of the present invention to provide an apparatus for stabilizing and spacing truss members. The apparatus includes an elongated channel member having a middle portion, a first arm portion, and a second arm portion. The first arm portion and second arm portion extend outwardly from the middle portion. A plurality of U-shaped clamp members may be disposed along the length of the elongated channel member. At least one U-shaped clamp member is located at the middle portion providing a centered layout for spacing a first truss member in relation to a second truss member. A hinge member may pivotally attach the middle portion of the elongated channel member to the second arm portion allowing the second arm portion to swing onto an additional truss member.

In another example embodiment, the truss stabilizing apparatus may further include a locking pin configured to lock the elongated channel member in a fixed a position, wherein the locking pin may be spring loaded. The elongated channel member has telescopic first and second arm portions that are secured to a desired length via the spring loaded locking pin.

In yet another example embodiment, the elongated channel member may be comprised of ABS plastic with injection molding. Additionally, the elongated channel member may be composed of steel tubing.

In another example embodiment, additional truss members can be affixed to the elongated channel member from a central truss member. The additional truss members are affixed to the elongated channel member by the U-shaped clamps disposed on the first arm portion and the second arm portion. The U-shaped clamp members may be affixed to the sides of the truss member via a middle truss area.

In another example embodiment, the truss stabilizing apparatus may further include a hinge mechanism, wherein the hinge mechanism can be adjusted for installation of one or more truss members.

In another example embodiment, the first arm portion and second arm portion are on distal ends of the elongated channel member. At least one U-shaped clamp is on each of the middle portion, first arm portion, and second arm portion. The U-shaped clamps are configured to clamp a central truss member at the middle portion, the first truss member at the first arm portion, and a second truss member at the second arm portion.

The apparatus described above is advantageous because it simplifies the setting of trusses, increases worker safety while setting trusses, reduces the number of workers and associated labor involved in the setting of trusses, provides a single tool for both the setting and the spacing of trusses.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
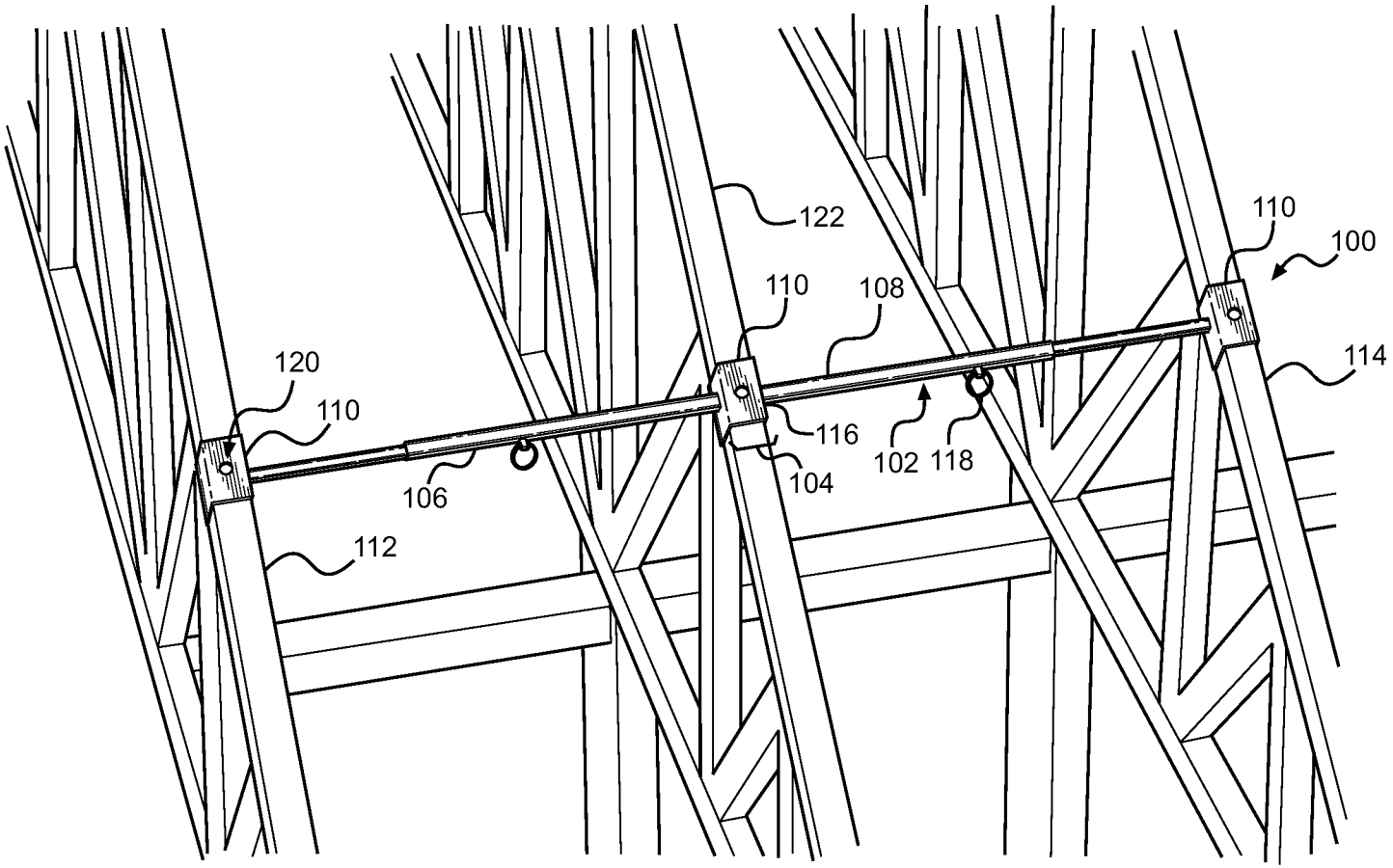
FIG. 1 shows the apparatus for spacing and stabilizing a roof truss according to one embodiment of the present invention.

Reference is made herein to the attached drawings. Like reference numerals are used throughout the drawings to depict like or similar elements of the apparatus for stabilizing and spacing truss members. For the purposes of presenting a brief and clear description of the present invention, the preferred embodiment will be discussed as used for installing a roofing structure. The figures are intended for representative purposes only and should not be considered to be limiting in any respect.

The present invention aids in both the installation and stabilization of roof trusses. The invention enables users to hold trusses in place in an accurate and central position until secured to a roof. The invention eliminates the need to cut temporary blocks or boards for spacing and saves time for users by not having to lay out lineal boards for spacing. The invention can save the user a significant amount of time and prevents wasted material.

Figure 3:
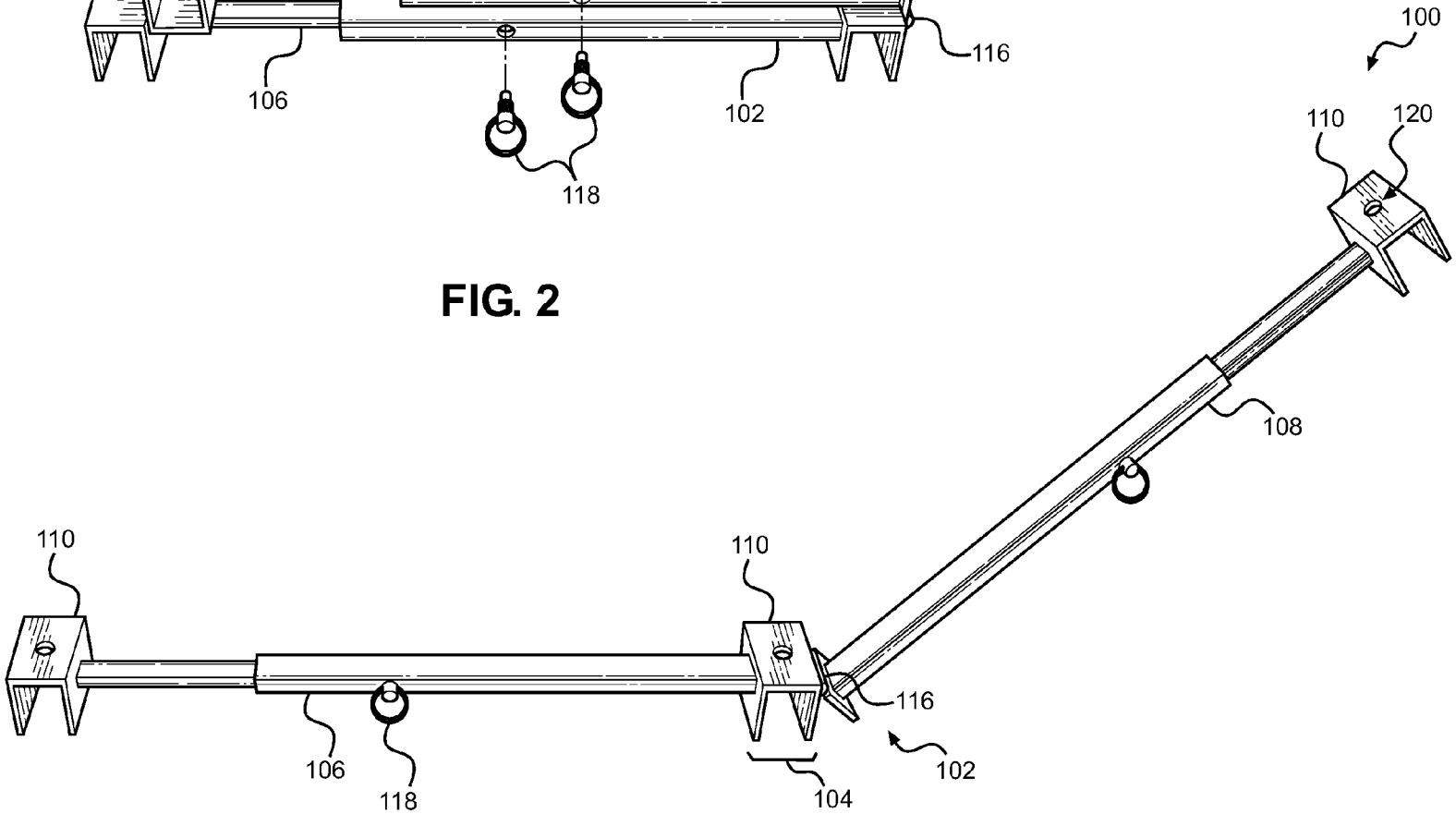
FIG. 3 shows the apparatus for spacing and stabilizing a roof truss with U-shaped clamp members and a locking pin according to one embodiment of the present invention.

Referring now to FIGS. 1 and 3, there is shown an apparatus 100 for spacing and stabilizing roof trusses. The apparatus includes an elongated channel member 102, a plurality of U-shaped clamp members 110, and a hinge member 116. The elongated channel member 102 has a middle portion 104, a first arm portion 106, and a second arm portion 108. The middle portion 104 is a clamp member 110. The first arm portion 106 and second arm portion 108 extend outwardly from the middle portion 104 and are preferably disposed on opposing sides of the middle portion 104. In one configuration, the first arm portion 106 and the second arm portion 108 are collinear.

The first arm portion 106 and second arm portion 108 include U-shaped clamp members 110 on distal ends of the elongated channel member 102. The first arm portion 106 and second arm portion 108 are telescopic adapted to extend and retract to a desired length. The U-shaped clamp members 110 are adapted to secure the trusses in upright positions such that the trusses are spaced from one another. According to one embodiment of the present invention, the elongated channel member 102, first arm portion 106 and second arm portion 108 may be composed of injection molded ABS plastic. In another embodiment, the elongated channel member 102 comprises steel tubing.

A plurality of U-shaped clamp members 110 may be disposed along a length of the elongated channel member 102. At least one U-shaped clamp member 110 is located at the middle portion 104 providing a centered layout from a central truss member 122 for spacing a first truss member 112 in relation to a second truss member 114. In a preferred embodiment of the present invention, at least one U-shaped clamp member 110 is located at each of the middle portion 104, the first arm portion 106, and the second arm portion 108.

The U-shaped clamp members 110 are located at distal ends of the first arm portion 106 and the second arm portion 108. The U-shaped clamp member 110 at the middle portion 104 removably attaches to a central truss member 122 and the U-shaped clamp member 110 at the first arm portion removably attaches to a first truss member 112. A second truss member 114 may be affixed to the elongated channel member 102 by the U-shaped clamp 110 at the second arm portion 108. In a preferred embodiment, the apparatus 100 provides a 24 inch center layout for the central truss member 122, the first truss member 112, and second truss member 114. It is also contemplated that a locking pin 118 can adjust the length of the first arm portion 106 and the second arm portion 108 to provide different centered layouts. The arm portions may comprise an outer tube and an inner tube, wherein the inner tube is configured to slide within the outer tube. The outer tube and inner tube have apertures for receiving a locking pin.

The U-shaped clamp members include receiving apertures 120 on a top portion of the U-shaped clamp members 110. The receiving apertures 120 are configured to receive a fastener, such as a nail, to hold the apparatus 100 in place when a truss member is installed. The nails allow the truss members to be securely held on the top plate of a wall frame and spaced at 24 inch center layouts while the truss members are installed.

The hinge member 116 pivotally attaches the middle portion 104 of the elongated channel member 102 to the second arm portion 108. The hinge member 116 allows the elongated channel member 102 to pivot in order to enable users to secure the apparatus onto more than one truss at a time. In a preferred embodiment, the U-shaped clamp member 110 at the middle portion 104 attaches to a central truss member 122, the U-shaped clamp member at the first arm portion 106 attaches to a first truss member 112, and the U-shaped clamp member 110 at the second arm portion 108 attaches to a second truss member 114. The hinge member 116 allows the second arm portion to swing onto the second truss member 114. In this arrangement, the apparatus can secure three truss members simultaneously.

The apparatus reduces time spent measuring and cutting 25½" blocks for a 24 inch center layouts for typical residential truss spacing. It is common in the industry for the carpenters to cut these blocks before they start rolling trusses. On a typical roof, this one act alone can save a laborer or carpenter an hour or more of time. It is also safer as a carpenter does not need to use a saw to cut the blocks so there is less chance of an accident. Additionally, it saves time wasted on laying-out 24 inch centers on lineal 2×4's used for the temporary horizontal stabilizers. These 2×4 stabilizers are typically located at the midway point and lay flat on top of the trusses as the trusses are being installed to hold the trusses stable while the roof is being sheeted with plywood.

Figure 2:
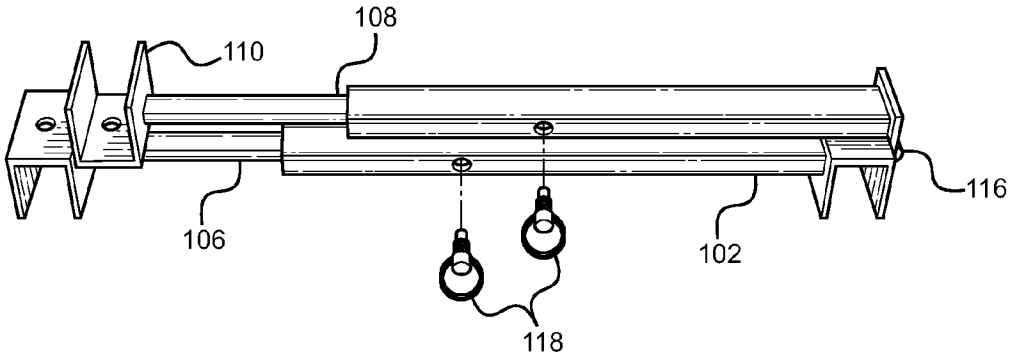
FIG. 2 shows the apparatus for spacing and stabilizing a roof truss in a pivoted position according to one embodiment of the present invention.

Referring now to FIG. 2, there is shown the apparatus 100 for spacing and stabilizing a roof truss in a pivoted position according to one embodiment of the present invention. The elongated channel member 102 can be adjusted via a hinge mechanism 116 which pivotally connects the second arm portion 108 to the elongated channel member 102. The elongated channel member 102 is in a pivoted position for easy assembly to additional truss members. The u-shaped clamp members 110 may have receiving apertures to receive a nail thereby securing the apparatus to the truss members.

The hinge mechanism 116 allows installation of one or more truss members from a central truss member. The hinge mechanism 116 may comprise a piece that can be retracted to a sixteen inch center layout via a spring loaded pin, thus aiding users with implementing accurate spacing for exterior stud placement in new wall construction. The device further enables users to properly space worn exterior studs when required during remolding and can hold the stud steady when nailing.

According to one embodiment, the first arm portion 106 and the second arm portion 108 have variable lengths. A locking pin 118 may be disposed on the first arm portion 106 and the second arm portion to lock the first arm portion 106 and the second arm portion 108 at a specific length. The locking pin 118 is configured to lock the arms of the elongated channel member 102 in a fixed a position. In an extended configuration, the locking pin 118 holds the first arm portion 106 and the second arm portion 108 at 24 inch centers. In a retracted configuration, the locking pin 118 holds the first arm portion 106 and the second arm portion 108 at 16 inch centers. The first arm portion 106 and the second arm portion 108 are 22.5 inches in length when extended for 24 inch center layouts; and 14.5 inches in length when retracted for 16 inch center layouts.

Figure 4:
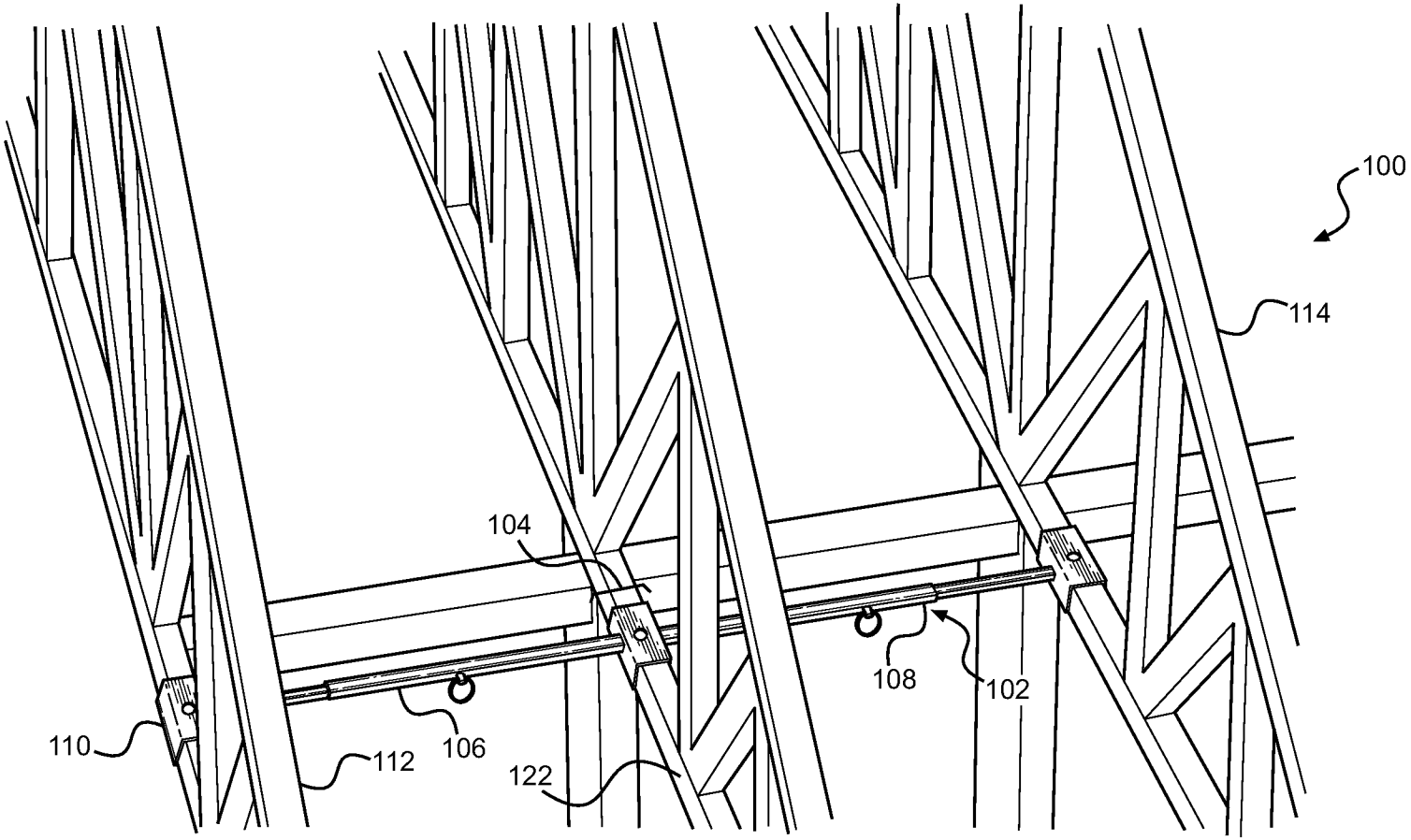
FIG. 4 shows the apparatus secured to a roof truss according to one embodiment of the present invention.
Figure 5:
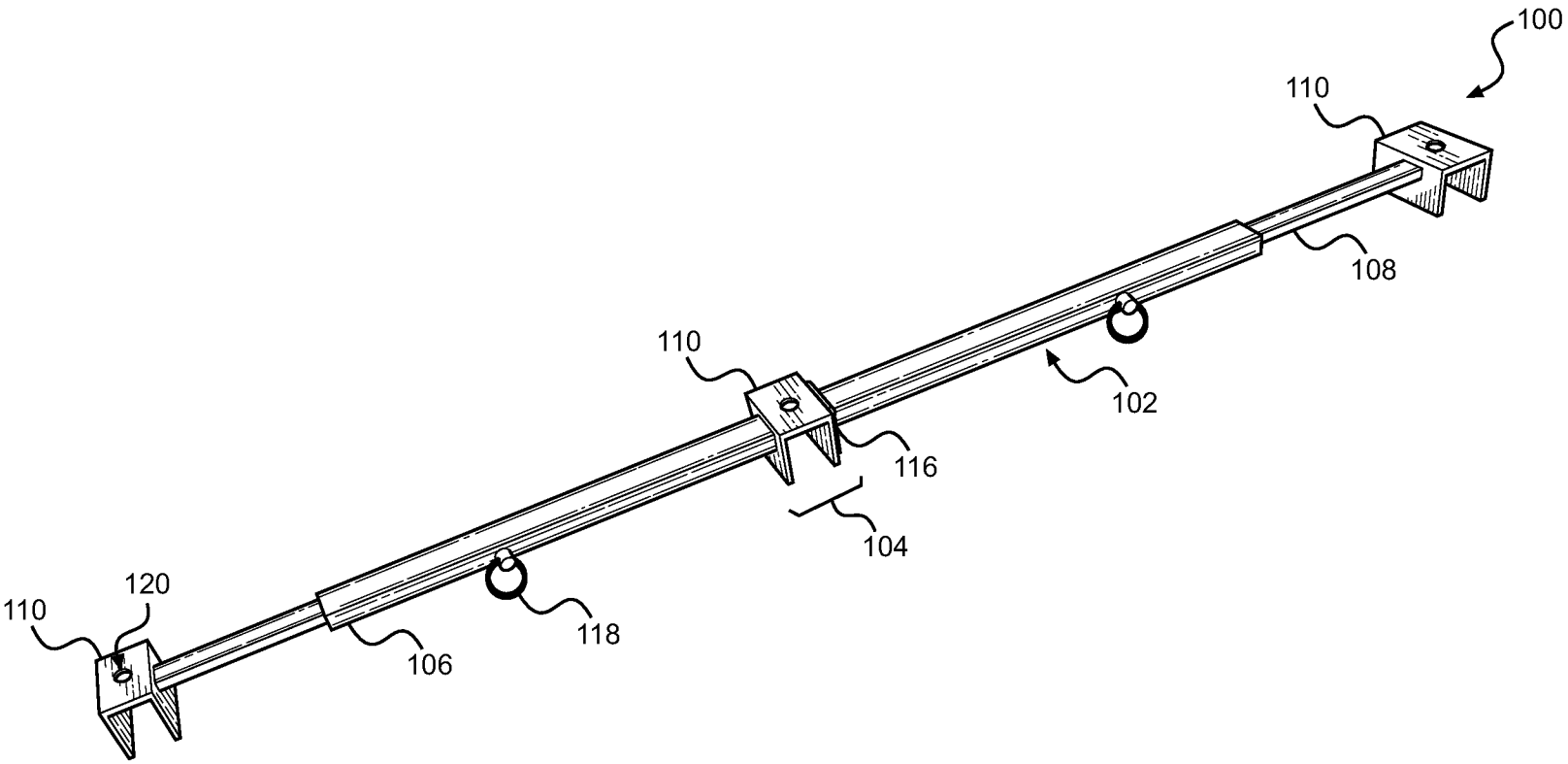
FIG. 5 shows the apparatus for spacing and stabilizing a roof truss according to one embodiment of the present invention.

Referring now to FIGS. 4 and 5, there is shown the apparatus 100 secured to the interior of a roof truss according to embodiments of the present invention. The invention provides a truss and wall layout and stabilizer tool that can aid the user with the safe and efficient installation of roof trusses. The device may include an elongated channel member 102 having U-shaped clamp members 110 located along the length thereof. A U-shaped clamp member 110 on the middle portion 104 of the elongated channel member 102 is removably attached to a central truss member 122, thereby providing a centered layout for properly spacing a first truss member in relation to a second truss member. The elongated channel member 102 can further include a hinge mechanism 116 in order to enable users to secure the elongated channel member 102 onto more than one truss at a time.

According to one embodiment of the present invention, additional truss members can be affixed to the elongated channel member 102 from a central truss member. The additional truss members are affixed to the elongated channel member 102 by the U-shaped clamps 110 at the first arm portion 106 and the second arm portion 108. The U-shaped clamp members 110 are affixed to the sides of the truss member via a middle truss area.

According to yet another embodiment of the present invention, the elongated channel member 102 may be in a locked 24 inch center configuration. The first arm portion 106 and the second arm portion 108 both include locking pins 118. The locking pins 118 allows a user to adjust the elongated channel member from 24 inch centers to 16 inch centers. The u-shaped clamp members 110 may include receiving apertures 120 at the top portion of the u-shaped clamp members 110. The receiving apertures 120 at the top portion of the u-shaped clamp members 110 are configured to receive a securing device such as a nail. The hole in the top of the clamp members holds the truss/joist so a user can drive a nail into the truss. This holds the apparatus 100 in place if it needs to stay attached to the truss/joist for a short time.

The apparatus 100 additionally eliminates the need for measuring layouts for rat runs. Rat runs are located on the interior of the truss members and are used to stiffen and align ceiling runners. Typically, one skilled in the art will lay lineal 2×4 wood pieces on a flattened surface, even the ends of the 2×4 wood pieces, and measure a 24 inch center lay-out down the complete length. With the apparatus 100 of the present invention, this task is completely eliminated. Once the apparatus is secured to the next unsecured truss, it provides a 24 inch center lay-out and the ceiling runner is aligned and ready to be installed.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method for setting trusses in building construction, comprising:

providing a first truss member and a second truss member spaced apart on a top plate of a wall, wherein the first truss member is secured to the top plate of the wall;

securing an apparatus for spacing and stabilizing roof trusses to the first truss member and the second truss member, the apparatus comprising:

a first elongated channel member having first and second opposite distal ends;

a second elongated channel member having first and second opposite distal ends;

each of the first and second elongated members are telescopic;

first, second and third u-shaped clamp members, the first and second u-shaped clamp members are mounted to and extend from the first and second distal ends of the first elongated channel member, respectively, providing a centered layout for spacing the first truss member in relation to the second truss member, and the third u-shaped clamp member is mounted to and extends from the first distal end of the second channel member;

a hinge member located on at least one of the first and second clamp members pivotally attaching the first elongated channel member to the second distal end of the channel member;

providing a third truss member;

rolling the third truss member to the top plate of the wall;

swinging the second elongated channel member onto the third truss member via the hinge;

securing the second elongated channel member to the third truss member; and removing the apparatus when the second truss member and the third truss member are secured to the top plate of the wall.

2. An apparatus for spacing and stabilizing roof trusses, comprising;

a first elongated channel member having first and second opposite distal ends, a second elongated channel member having first and second opposite distal ends, first, second and third u-shaped clamp members, the first and second u-shaped clamp members are mounted to and extend from the first and second distal ends of the first elongated channel member, respectively, for spacing a first truss member in relation to a second truss member, and the third u-shaped clamp member is mounted to and extends from the first distal end of the second channel member for spacing a third truss member in relation to the second truss member; and a hinge located on at least one of the first and second clamp members pivotally attaching the first elongated channel member to the second distal end of the second elongated channel member, such that when in use the first and second elongated channel members space the first, second and third truss members;

wherein each of the first elongated channel member and the second elongated channel members are telescopic.

3. The apparatus of claim 2, further comprising one or more locking pins on the elongated channel members, wherein the locking pins are configured to lock the elongated channel members at a fixed length.

4. The apparatus of claim 3, wherein the one or more locking pins are spring loaded.

5. The apparatus of claim 2, wherein the elongated channel members comprise ABS plastic with injection molding.

6. The apparatus of claim 2, wherein the elongated channel members comprise steel tubing.

7. The apparatus of claim 2, wherein the u-shaped clamp members include receiving apertures on a top portion of the u-shaped clamp members, wherein the receiving apertures are configured to receive a fastener there through.

* * * * *